United States Patent [19]

Nuttal et al.

[11] 4,445,868

[45] May 1, 1984

[54] APPARATUS FOR PRODUCING RUBBINGS

[75] Inventors: Michael Nuttal, So. Pasadena; Shoji Yamamoto, Westminster, both of Calif.

[73] Assignee: Tomy Corporation, Carson, Calif.

[21] Appl. No.: 404,132

[22] Filed: Aug. 2, 1982

[51] Int. Cl.[3] ..... B43L 13/00

[52] U.S. Cl. ..... 434/88; 101/373

[58] Field of Search ..... 46/37, 29; 101/372, 101/373; 434/81, 85, 87, 88, 96, 73, 163, 164, 174, 198, 410, 402, 403; D21/59

[56] References Cited

U.S. PATENT DOCUMENTS

| | | | |
|---|---|---|---|
| D. 264,232 | 5/1982 | Lang | D21/59 |
| 3,010,227 | 11/1961 | Glass | 434/174 |
| 3,462,857 | 8/1969 | Glass et al. | 434/402 |
| 3,484,952 | 12/1969 | Coldren | 434/88 |
| 4,104,810 | 8/1978 | Mirman | 434/73 |
| 4,182,072 | 1/1980 | Much | 46/29 X |

FOREIGN PATENT DOCUMENTS

| | | | |
|---|---|---|---|
| 831068 | 2/1952 | Fed. Rep. of Germany | 46/37 |
| 2807106 | 9/1978 | Fed. Rep. of Germany | 101/372 |
| 2829868 | 1/1980 | Fed. Rep. of Germany | 101/373 |

OTHER PUBLICATIONS

Tomy Corp. Catalog 1979, "Fashion Plates" and Mighty Men Maker, Jun. 6, 1979.

"Toss'n Turn", p. 497, Sears 1975 Xmas Catalog.

*Primary Examiner*—Harland S. Skogquist

*Attorney, Agent, or Firm*—K. H. Boswell; Edward D. O'Brian

[57] ABSTRACT

An apparatus capable of being used by a child for the production of rubbings includes a housing which is divided into a first section and a second section. The second section is hinged to the first section. At least two elements are located in the first section. Each of the elements has a plurality of independent surfaces with raised relief indicia located on the surfaces. The elements are rotatably mounted in the first section so as to locate at any one time one of the surfaces on each of the elements in a working plane. Each of the surfaces so located in the working plane is capable of supporting material which is capable of receiving a rubbing. The second section is positionable on the first section in a holding position, so as to hold the material against the surfaces in the working plane during the production of the rubbing. The rubbing is produced by drawing a crayon or the like over the surface of the material to transfer the outline of the raised relief on to the material.

11 Claims, 7 Drawing Figures

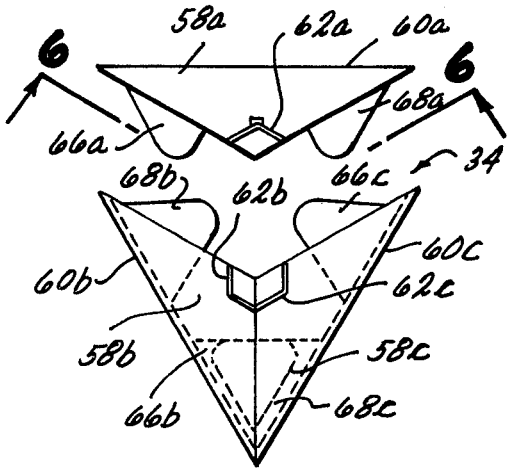
FIG. 5
FIG. 6
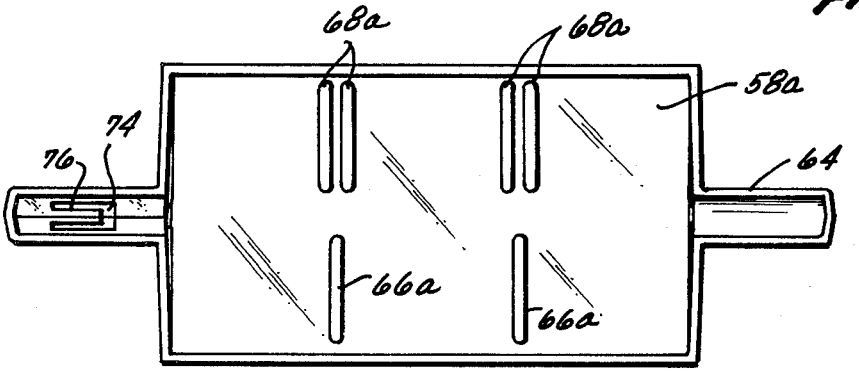
FIG. 7
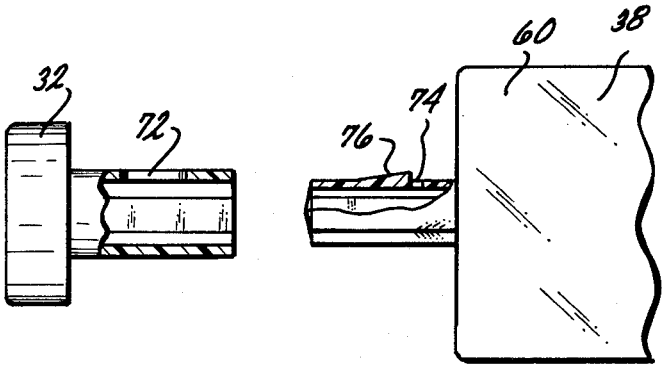

APPARATUS FOR PRODUCING RUBBINGS

BACKGROUND OF THE INVENTION

This invention is directed to an apparatus for producing rubbings wherein a plurality of elements having a multiplicity of surfaces each having raised relief indicia located thereon are located adjacent to one another and are movable with respect to one another such that the rubbing produced is dependent upon which of the surfaces of each of the elements is utilized in production of the rubbing.

A series of toys sold under the Trade Names of Fashion Plates®, Mighty Men and Monster Makers®, Great Greetings®, Little Van Goes® and Pony Plates® are produced and sold by the assignees of this invention. These toys all utilize a housing which is adapted to receive a combination of plates each having a raised relief thereon. A piece of paper is placed over the combination of the plates and a crayon or the like is rubbed over the top of the piece of paper. The pattern formed by the raised relief is transferred to the surface of the paper upon rubbing the same with the crayon. These toys have met with large public acceptance and provide excellent play value for the age group to which they are directed.

The toys described in the above paragraph are generally directed to those children ages six and up. In utilizing the toy, it requires that the child place the individual plates within the housing to produce the rubbing. The plates are not attached, and as such, when utilized by smaller children, the plates could easily become lost or mislaid. The small child however, is perfectly capable of producing rubbings by locating the paper over the series of plates and rubbing the same with a crayon.

A dilemma has therefore been created. In one instance, the rubbing type toy is quite enjoyable in use by the small child. However, because of the disattached parts, the small child has difficulty in maintaining the parts in an assembly for storage and the like and may, at times, especially with very young children, be unable to assemble the plates in the housing.

In view of the above, it is considered that there exists a need for an apparatus which is capable of producing rubbings, yet is fully usable by the pre-schooler without assistance. It is further considered that there exists a need for an apparatus capable of producing rubbings wherein all the parts are joined in one apparatus and as such cannot become separated or lost.

BRIEF DESCRIPTION OF THE INVENTION

It is a broad object of this invention to therefore produce an apparatus capable of producing rubbings which can be used by a small child and which has all of the component parts unified into a single apparatus and thus having the parts inseperable. It is a further object of this invention to produce an apparatus for producing rubbings which is capable of producing a variety of different rubbings without having the requirement of having a plurality of disjoined parts. It is a further object of this invention to produce an apparatus capable of producing rubbings which, because of its simplicity of engineering and manufacture, is both capable of an extended useful toy life, and is economical to the consumer.

These and other objects, as will become evident from the remainder of this specification are achieved in an apparatus for producing rubbings which comprises: a housing divided into a first section and a second section, said second section movable with respect to said first section; at least two elements rotatably mounted in said first section, each of said elements having at least two independent surfaces with raised rubbing producing relief located on said surfaces, said elements rotatable in said first section so as to locate at any one time one of the surfaces on each of the elements in a working plane, said surface so located in said working plane capable of supporting a material capable of receiving a rubbing; said second section positionable on said first section in a holding position so as to hold said material against said working plane during production of a rubbing.

Each of the elements would have at least two faces and preferredly would have three, such that a plurality of different rubbings could be produced with the apparatus. Preferredly, three or more of said elements would be utilized such that the rubbing so produced with the apparatus is capable of being varied extensively. With three of said elements each having three faces, twenty-seven different rubbings could be so produced.

In the preferred embodiment of the invention, the second section would include means thereon capable of engaging each of the surfaces of each of the elements which lie in the working plane and maintaining these surfaces in the working plane when the second section is positioned with respect to said first section in the holding position.

In the preferred embodiment, means would be included which would be connected to each of the elements and extend out of the first section and would be positioned such that they could be operated on by the digits of the user of the apparatus to rotate each of the elements with respect to the apparatus. Such rotation of each of the elements would change which of the surfaces on each of the elements is located in the working plane.

In the preferred embodiment of the invention, the second section would be hinged to the first section and would move between an open position and a holding position. In the open position the elements could be rotated to change the surfaces of each of the elements which are located in the working plane and the material on which the rubbing is to be made could be inserted between the first and second sections.

Preferredly, each of the elements is shaped as a triangular prism with the raised relief located on the lateral faces of said prism with each of the prisms rotatably mounted to the housing via the triangular faces.

BRIEF DESCRIPTION OF THE DRAWINGS

This invention will be better understood when taken in conjunction with the drawings wherein:

FIG. 5 is a partially exploded view of one of the triangular prism elements viewable in FIG. 2;

FIG. 6 is a top plan view about the line 6—6 of FIG. 5;

FIG. 7 is a side elevational view in partial section about the line 7—7 of a portion of one of the components as seen in FIG. 2.

Figure 1:
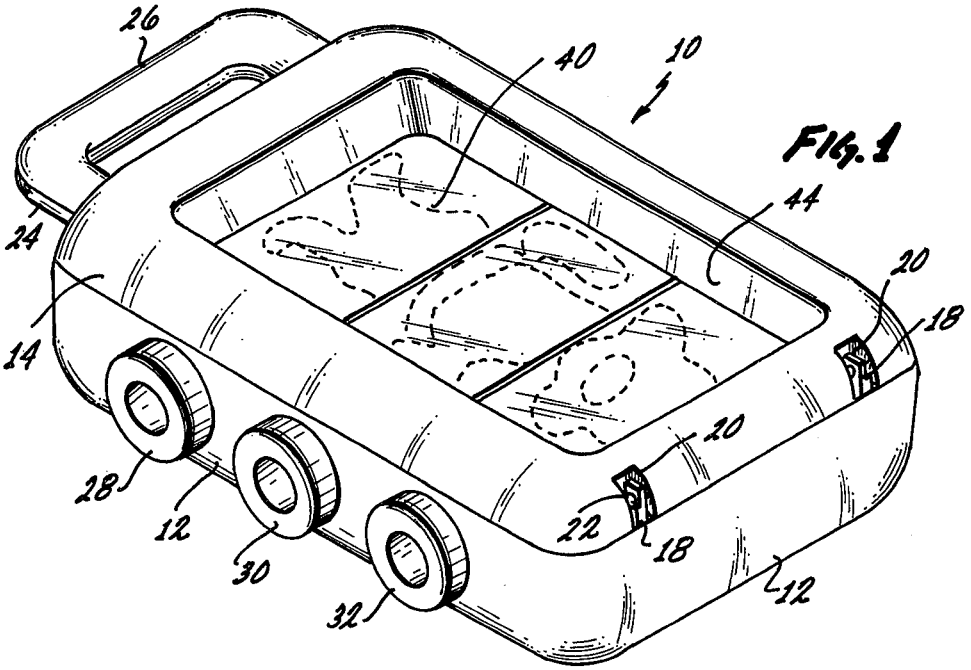
FIG. 1 is an oblique view showing the preferred embodiment of the invention.

The invention described in this specification and illustrated in the drawings utilizes certain principles and/or concepts as are set forth in the claims appended hereto. Those skilled in the toy arts will realize that these principles and/or concepts are capable of being illustrated in a variety of illustrative embodiments. It is for this reason that this invention is not to be construed as being limited to the exact illustrated embodiment utilized herein, but is to be construed in light of the claims.

DETAILED DESCRIPTION OF THE INVENTION

In the several views of the FIGS., the apparatus for producing rubbings 10 is illustrated. Before describing all of the internal components of the apparatus, a brief description of certain external components and the method of operation of the apparatus will facilitate in further understanding of the same.

The apparatus 10 includes a lower housing 12, and an upper housing 14. Interspaced between the lower and upper housings 12 and 14 is an internal plate 16. The internal plate 16 is attached to the lower housing 12 by solvent welding, screws or the like and the upper housing 14 is hinged to the internal plate 16. Because of the attachment of the internal plate to the lower housing 12, therefore, the upper housing 14 is hinged to the combination of the lower housing 12 and the internal plate 16 after they are joined together. Two projections, collectively identified by the numeral 18 are located on the internal plate 16 and each includes a hole located therein (not separately identified or numbered). Two notches, collectively identified by the numeral 20, are located in the upper housing 14 and each include a small axle projection 22 located therein. Insofar as all of the components 12, 14, 16 and other components as hereinafter described forming parts of the apparatus 10 are formed of plastic materials, it is possible to press fit the upper housing 14 to the internal plate 16 thus locating the axles 22 within the projections 18 to mount the upper housing 14 to the internal plate 16.

The lower housing 12 includes a handle member 24 and the upper housing 14 includes a handle member 26 which abutt against one another when the upper housing 14 is closed onto the lower housing 12, such that in combination, the handle members 24 and 26 form a handle for carrying the apparatus 10.

Three knobs 28, 30 and 32 extend along one side edge of the apparatus 10 and are used to turn certain internal components as hereinafter explained.

Three elements 34, 36 and 38 are located within the interior of the apparatus 10 and connect to the knobs 28, 30 and 32. Each of the elements 34, 36 and 38 are shaped as triangular prisms, most specifically as right regular triangular prisms. The elements 34, 36 and 38 are connected to the knobs 28, 30 and 32 respectively and are rotated within the apparatus 10 by rotating the knobs 28, 30 and 32.

On each of the lateral faces of the elements 34, 36 and 38 there is located a raised relief indicia generally indicated by the numeral 40 in certain of the figures. The raised relief 40 is utilized in producing the rubbings.

Figure 4:
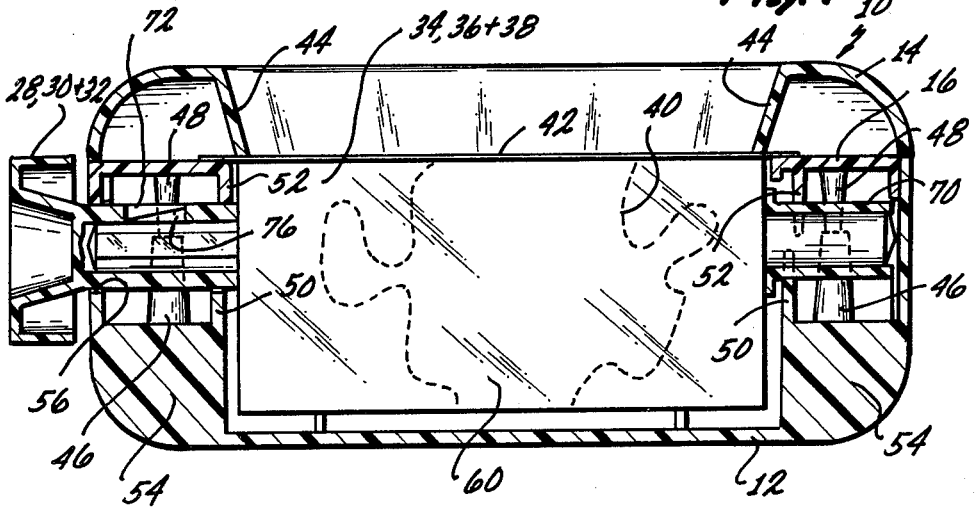
FIG. 4 is an end elevational view in section of the preferred embodiment of the invention.
Figure 2:
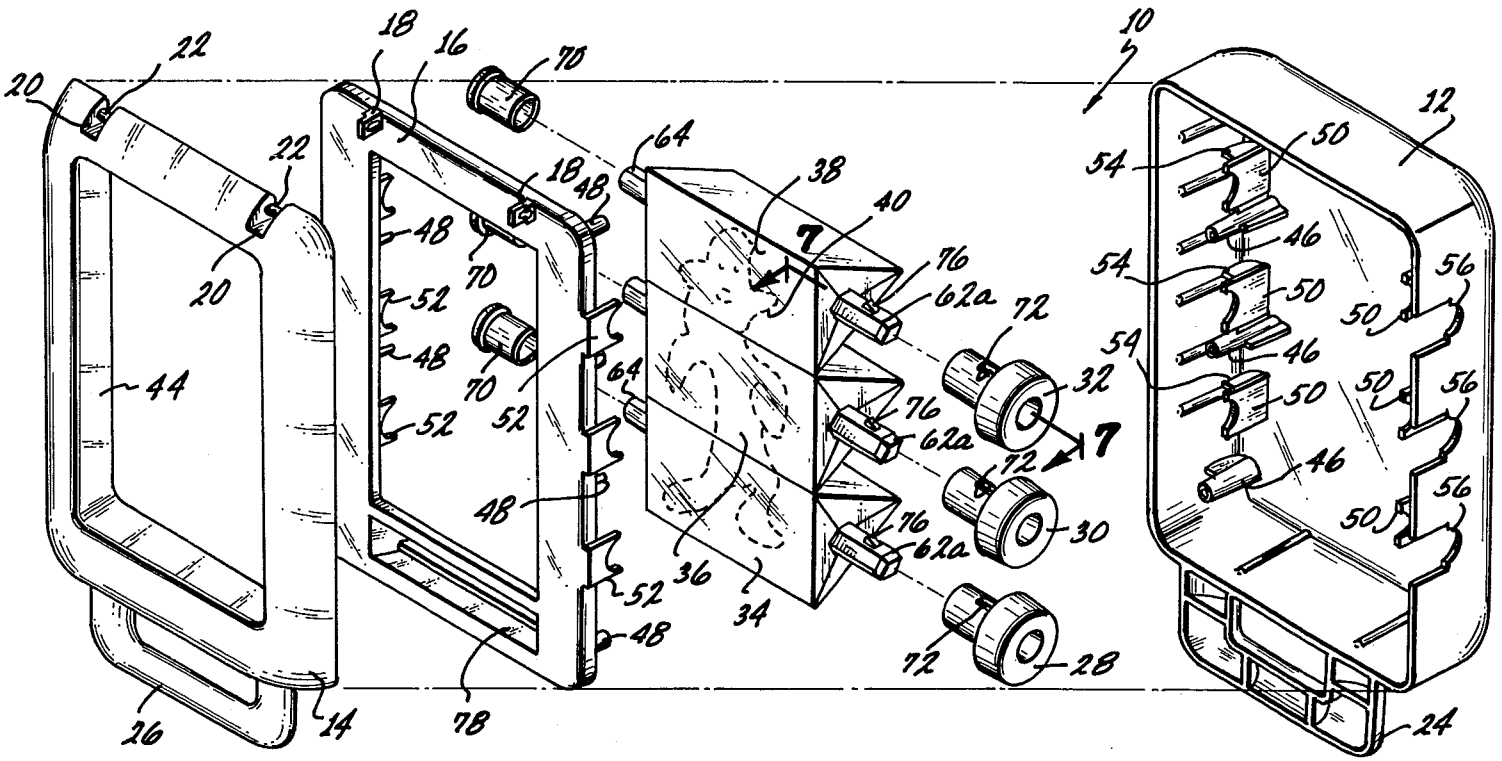
FIG. 2 is an exploded view of the embodiment of the invention.
Figure 3:
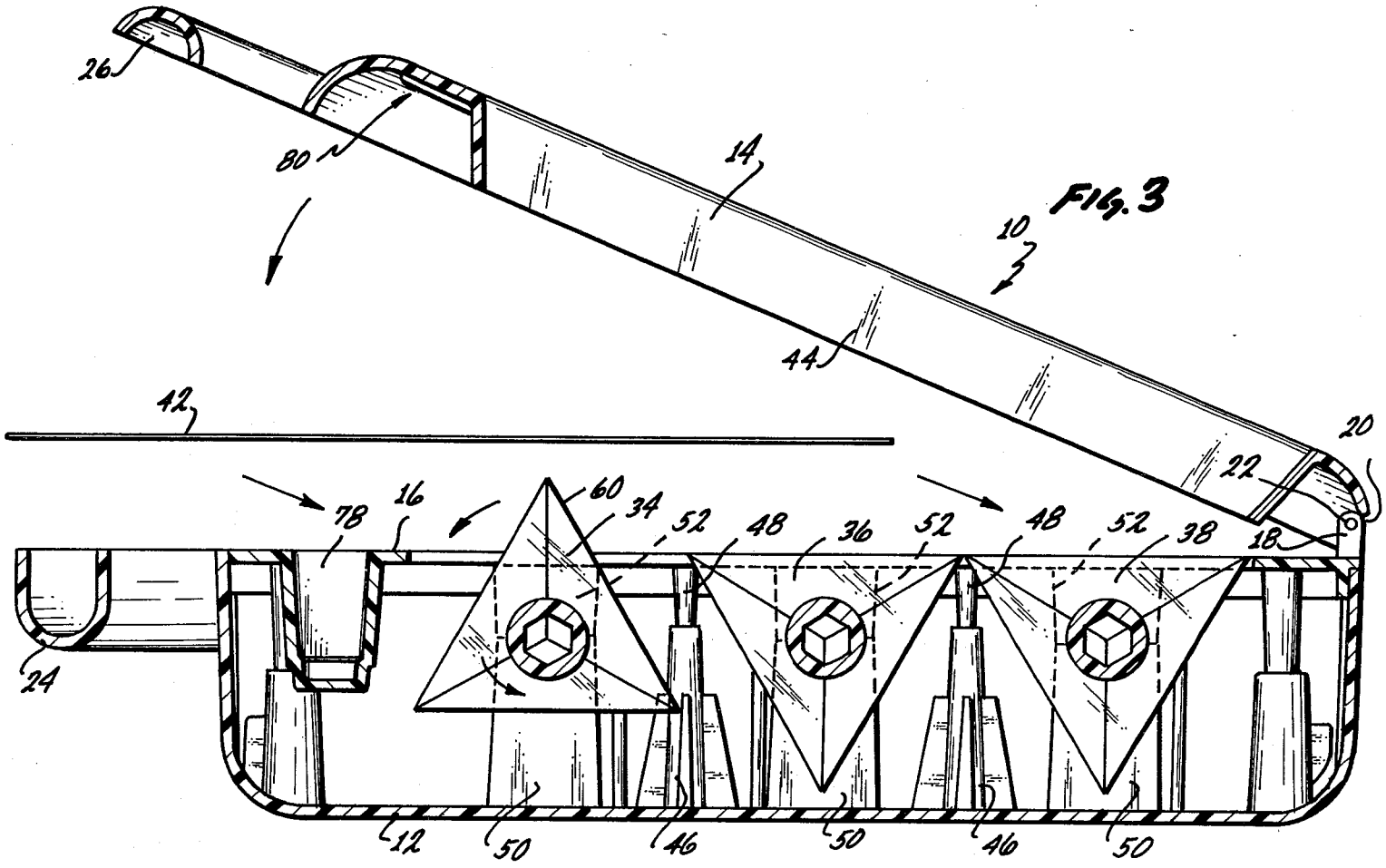
FIG. 3 is a side elevational view in section of the preferred embodiment of the invention.

When the elements 34, 36 and 38 are positioned as seen in FIGS. 1, 2 or 4, the horizontally oriented, lateral faces on the combined total of the elements 34, 36 and 38 are all located within a plane which can be described as a working plane. A piece of paper 42 is laid over this working plane by opening the upper housing 14 with respect to the lower housing 12, inserting the paper 42 onto the horizontal exposed surfaces of the elements 34, 36 and 38, and closing the upper housing 14 down onto the lower housing 12, maintaining the paper 42 within the apparatus 10. By rubbing a crayon or the like over the top surface of the paper, where the paper is held rigid by the raised relief 40, the crayon will leave a tracing, and where the paper 42 is not held rigid in those areas where the raised relief 40 is not located, no tracing will be left on the paper. In this way, a rubbing is transferred to the paper 42 which corresponds to the totality of the raised relief 40 exposed on each of the elements 34, 36 and 38.

Since each of the elements 34, 36 and 38 are independently rotatable with respect to the other, the portion of the raised relief 40 located on any particular element can be changed by simply rotating that element. It is thus seen that by using the combination of three elements 34, 36 and 38, each of which is shaped as a triangular prism, a totality of twenty seven different lateral faces are present, allowing for the production of twenty seven different rubbings with the apparatus 10.

Normally, since the apparatus 10 is geared to preschool children, the raised relief 40 on the individual elements 34, 36 and 38 will be of a characterized nature, normally those type of characters which a small child finds interesting, such as characterized animals, and the like.

The upper housing 14 includes a flange 44 which projects downwardly and inwardly. Along the longitudinal side edges the flange 44 contacts the surface of the paper 42 and holds the side edges of the paper 42 against the working plane, which, as noted above, is composed of the horizontally oriented lateral surfaces of the elements 34, 36 and 38. This does two things. First, it maintains the paper 42 fixed against this working plane, and secondly, it maintains the elements 34, 36 and 38 static with respect to one another, such that their horizontally oriented lateral surfaces form a smooth, continuous working plane which is not distorted by the pressure applied thereto when the crayon or the like is rubbed over the surface of the paper 42. The transverse portions of the flange 44 going cross-wise on the apparatus 10 do not need to push against the working plane in order to maintain the elements 34, 36 and 38 static within the apparatus 10, but simply serve to hold the paper 42 flat against the upper surface of the internal plate 16.

The internal plate 16 and the lower housing 12 contain a plurality of projections which serve to lock these two members together and to form bearing surfaces for supporting the elements 34, 36 and 38 therein. A plurality of upstanding bosses, collectively identified by the numeral 46, extend upwardly from the inside of the lower housing 12. A plurality of bosses, collectively identified by the numeral 48, extend downwardly from the bottom of the internal plate 16. When the internal plate 16 is mated against the lower housing 12, the bosses 46 contact the bosses 48 and by solvent welding the points of contact, the internal plate 16 is held against the lower housing 12.

However, prior to so fixing the internal plate 16 to the lower housing 12, the elements 34, 36 and 38 are inserted therein. A plurality of upstanding projections, collectively identified by the numeral 50, project upwardly from the lower housing 12. Each of the projections 50 includes a semicircular cutout on its upper edge. A complimentary set of projections 52 project downwardly from the internal plate 16. These projections 52 also include a semicircular cutout. The projections 50 form a lower bearing surface for each of the elements 34,36 and 38, whereas the projections 52 form the upper bearing surface. A baffle 54 joins each of the projections 50 to the side walls of the lower housing 12 to give added support to the projections 50 and the elements 34, 36 and 38 located thereon after assembly of the apparatus 10.

Three slots collectively identified by the numeral 56 are located in the side wall of the lower housing 12 and allow for extension of the knobs 28 through the lower housing 12.

Each of the elements 34, 36 and 38 is composed of three pieces. Since each of these elements 34, 36 and 38 are identical, the description of one will serve to describe all three. In FIGS. 5, 6 and 7, one of the elements 34 is shown broken apart to illustrate how it is constructed.

The element 34, as well as the other elements 36 and 38, are composed of three similar pieces 58*a*, 58*b* and 58*c*. Each of these pieces includes a lateral surface 60, one third of a hexagon shaped extension 62 and one third of a round extension 64. Further, on the inside of each of the pieces 58 are a set of single baffles collectively identified by the numeral 56 and a set of double baffles collectively identified by the numeral 68. The single baffles 66 are on one side of a longitudinal center line and the double baffles 68 are on the other side of the longitudinal center line.

The three pieces 58*a*, 58*b* and 58*c* are joined together to form the element 34, and likewise the elements 36 and 38. In joining the pieces 58*a*, *b* and *c*, the single baffles 66 fit in between the double baffles 68 on the abutting piece. Thus, in moving clockwise in FIG. 5 it can be seen that the single baffle 66 on piece 58*c* would fit between the double baffle 68 on piece 58*a*, with the single baffle 66 on piece 58*b* fitting within the double baffle on piece 58*c* and the single baffle 66 on piece 58*a* fitting within the double baffle 68 on piece 58*b*. The fit of the single baffles 66 within the double baffles 68 prevent longitudinal movement of the pieces 58*a*, *b* and *c* with respect to one another.

The pieces 58*a*, *b* and *c* are held together by slipping a collar 70 over the round extension 64 on one end of the elements 34, 36 and 38 and the knobs 28, 30 and 32 over the hexagon extensions 62 on the other end of these elements. The interior of each of the knobs 28, 30 and 32 is hollow and is hexagon shaped allowing for these knobs to fit over the hexagon extensions 62. Each of the knobs 28, 30 and 32 contain a cutout 72. On the hexagon extension 62*a* on piece 58*a* a cutout 74 is formed. The cutout 74 defines a projection 76 which is formed of material which is left in the center of the cutout 74. The projection 76 is somewhat wedge shaped such that when one of the knobs 28, 30 or 32 is slipped over the appropriate hexagon extension 62, the projection 76 fits into and locks in the cutout 72 on the appropriate knob 28, 30 or 32. This locks the knob 28, 30 or 32 on to the appropriate element 34, 36 or 38. The hexagon shape of the extension 62 fitting into the hexoganal hole in the knobs 28, 30 or 32 locks the appropriate element 34, 36 or 38 with respect to its knob 28, 30 and 32 such that when the appropriate knob 28, 30 or 32 is rotated, the respective element 34, 36 and 38 is also rotated.

The individual pieces 58*a*, *b* and *c* differ from one another in two respects. The piece 58*a* contains the projection 76, whereas the pieces 58*b* and *c* do not. Further, on the individual lateral surfaces 60*a*, 60*b* and 60*c* the raised relief indicia located thereon is different such that a variety of characters, figures or the like can be formed by the combination of the three elements 34, 36 and 38. The interiors of each of the elements 34, 36 and 38 however, are similar with regard to the presence of the baffles 66 and 68 and the formation of the hexagon and round extensions 62 and 64.

Once the individual pieces 58*a*, *b* and *c* of each of the elements 34, 36 and 38 are aligned with respect to one another and held with respect to one another by insertion of the knobs 28, 30 and 32 over their one end and the collar 70 over the other end, these pieces can be set into the lower housing 12. The knobs 28, 30 and 32 project out of the lower housing 12 by passing through the slots 56. The knobs 28, 30 and 32 rest in the projections 50 which are located adjacent to the slots 56. The collars 70 rest in the projection 52 which are located distal from the slots 56. The internal plate 16 is then fitted against the lower housing 12. In so fitting, the projections 52 fit either against the knobs 28, 30 or 32 on one side of the apparatus 10 or against the collars 70 on the other side of the apparatus 10. It can be seen then that the elements 34, 36 and 38 are pivotally mounted within the apparatus 10 by the combination of the projections 50 and 52 serving as bearing surfaces for the knobs 28, 30 and 32 and the collars 70.

A recess 78 in the internal plate 16 and a corresponding recess 80 in the upper housing 14 together serve as a storage compartment for a crayon or the like, not numbered or shown, which is a utilized in producing rubbings with the apparatus 10. When the upper housing 14 is closed down over the lower housing 12, the recesses 78 and 80 are located adjacent to one another such that the crayon or the like can be appropriately stored in the apparatus 10.

It is of course evident that a lesser or greater number of the elements 34, 36 and 38 could be utilized in producing rubbings. The greater the number of elements, the greater the number of possibilities of modifying the rubbing produced with the apparatus.

For brevity of illustration in the FIGS., in certain of the FIGS. wherein the elements 34, 36 or 38 are shown thereon, the raised relief 40 on the lateral surfaces 60 is not illustrated.

I claim:

1. An apparatus for producing rubbings which comprises:

a housing divided into a first section and a second section, said second section movable with respect to said first section;

at least two elements rotatably mounted in said first section, each of said elements having at least two independent surfaces with raised rubbing producing relief located on said surfaces, said elements rotatable in said first section so as to locate at any one time one of the surfaces in each of said elements in a working plane, said surfaces so located in said working plane capable of supporting a material capable of receiving a rubbing;

said second section positionable on said first section in a holding position so as to hold said material against said surfaces in said working plane during production of a rubbing;

each of said elements is triangular in cross section and includes three surfaces, each of said elements rotatably mounted in said first section such that said working surfaces are capable of each lying within said working plane;

each of said elements includes three members, each of said members having an essentially planar rectangular shaped surface with said surface including said raised rubbing producing relief located thereon;

each of said members having first and second triangular shaped side walls located on opposite sides of said rectangular shaped surface;

said three members of each of said elements fitting together so as to form a triangular prism with said rectangular shaped surfaces of said members forming the lateral faces of said prism and the totality of said first side walls together forming one of the bases of said prism and the totality of said second walls together forming the other of the bases of said prism;

each of said side walls including an elongated axle segment extending outwardly from said side walls with the axle segment on said first side wall coaxial with the axle segment on said second side wall, the totality of all of said axle segments in the first side wall of each of said three members of each of said elements fitting together to form a first axle when said members are fitted together, the totality of said axle segments on the second side wall of each of said three members of each of said elements fitting together to form a second axle when said members are fitted together, said first axle coaxial with said second axle;

each of said elements rotatably mounted in said first section of said housing by said first and said second axles.

2. The apparatus of claim 1 wherein:

said first axle is shaped as a multi sided polygon and further including knob means having a multi sided polygonal opening therein capable of fitting on said multi sided polygon shaped axle, said knob means for rotating said element to which it is fitted in said housing.

3. The apparatus of claim 1 including:

three of said elements, said three of said elements aligned with respect to one another such that the surface on one of said elements which is in said working plane is located between the surfaces of the other of said elements which are in said working plane.

4. The apparatus of claim 3 including:

said second section including means capable of engaging each of the surfaces of each of said elements which are located in said working plane and maintaining said surfaces in said working plane when said second section is in said holding position.

5. The apparatus of claim 4 wherein:

said means capable of engaging said surfaces comprises flange means located on said second section, said flange means sized and shaped to be positioned adjacent to a portion of the surface of each of said elements which lies in said working plane when said second section is in said holding position.

6. The apparatus of claim 5 wherein:

said second section is hinged to said first section and moves between an open position and said holding position, in said holding position said flange being spaced away from said surface in said holding plane by an amount sufficient to allow positioning of said material between said surfaces and said flange means.

7. The apparatus of claim 1 including:

said second section including means capable of engaging each of the surfaces of each of said elements which are located in said working plane and maintaining said surfacs in said working plane when said second section is in said holding position.

8. The apparatus of claim 7 including:

three of said elements, said three elements aligned with respect to one another such that the surface on one of said elements which is located in said working plane is located between the surfaces on the other of said elements which are in said working plane.

9. The apparatus of claim 1 including:

collar means, said collar means fitting on said second axle so as to hold said segments of said second axle in association with each other.

10. The apparatus of claim 9 wherein:

said collar means functions as a bearing means for said second axle in said housing.

11. The apparatus of claim 10 wherein:

said first axle is shaped as a multi sided polygon and further including knob means capable of fitting on said multi sided polygon shaped axle, said knob means for rotating said element to which it is fitted in said housing.

* * * * *